US007475878B1

(12) United States Patent
Ko

(10) Patent No.: US 7,475,878 B1
(45) Date of Patent: Jan. 13, 2009

(54) WAGERING SETTLEMENT METHOD FOR CASINO GAMES

(75) Inventor: Bernard Chung Bon Ko, Foster City, CA (US)

(73) Assignee: TAJA Enterprises, LLC, Incline Village, NV (US)

( * ) Notice: Subject to any disclaimer, the term of this patent is extended or adjusted under 35 U.S.C. 154(b) by 286 days.

(21) Appl. No.: 11/397,302

(22) Filed: Apr. 3, 2006

Related U.S. Application Data

(60) Provisional application No. 60/734,801, filed on Nov. 8, 2005, provisional application No. 60/696,079, filed on Jun. 30, 2005.

(51) Int. Cl.
*A63F 1/00* (2006.01)

(52) U.S. Cl. ..... 273/292; 273/274; 463/13; 463/12

(58) Field of Classification Search ..... 273/292, 273/274, 309; 463/13, 12
See application file for complete search history.

(56) References Cited

U.S. PATENT DOCUMENTS 4,836,553 A * 6/1989 Suttle et al. ..... 273/292
5,411,268 A * 5/1995 Nelson et al. ..... 273/292

* cited by examiner

*Primary Examiner*—Benjamin H Layno
(74) *Attorney, Agent, or Firm*—Lewis and Roca LLP

(57) ABSTRACT

The invention comprises methods of settling wagers in a game with a Player/Dealer pool which entail reserving some of the funds in the Player/Dealer pool to pay bonuses and additional wagers and in some cases retiring more funds from the Player/Dealer pool than the amount won or lost. The invention also includes two optional mechanisms for implementing these methods. One method is a Base Bank and Reserve Bank where funds are reserved before any wagers are settled to pay bonuses and additional wagers. The other method is a Settlement Bank where the amount of funds to be retired is separated before wagers on a particular hand are settled.

14 Claims, 3 Drawing Sheets

WAGERING SETTLEMENT METHOD FOR CASINO GAMES

CROSS-REFERENCE TO RELATED APPLICATIONS

This application claims priority to co-pending U.S. Provisional Application Ser. No. 60/734,801, filed Nov. 8, 2005, and co-pending U.S. Provisional Application Ser. No. 60/696,079, filed Jun. 30, 2005, which are hereby incorporated by reference as if set forth herein.

BACKGROUND

1. Field of the Invention

The present invention relates to gaming and to wagering games. More particularly, the present invention relates to a group of games where one or more players, designated as the "Player/Dealer", puts up a pool or pools of money, the other players in the game make wagers, the winning player wagers are paid from the Player/Dealer's pool(s), the losing player wagers are paid to the Player/Dealer(s).

2. The Prior Art

Numerous casino wagering games are known in the prior art. In a wagering game, there must be a method of paying the winners. Three funding methods are typically used in casino games.

The most common method is where the casino or the "house" funds the wagers. The casino pays players who win, and the casino is paid the player wagers when the players lose. A game played against the casino is typically called a "banking game."

The second method is used in poker and pari-mutuel wagering. All the funds of the players are placed in a common pool. The game is played, and the money in the pool is paid to the winner or winners. The casino or racetrack may remove a percentage from the pool before the wagers are paid, or all of the pool may be paid to the winner or winners.

The third method is primarily used in jurisdictions, where banking games are not allowed. In it's simplest form, the players take turns taking on the role of "the house." That player may be designated the "Player/Dealer." The Player/Dealer puts up a wager or pool of money, and all the other players wager against the Player/Dealer. When a player wins, (s)he is paid from the Player/Dealer wager. When a player loses, the losing wager is paid to the Player/Dealer.

In a casino, the option to be Player/Dealer moves in a systematic way. Usually, each player has the option to be Player/Dealer for two hands, and then the option is offered to the player to his left. If a player chooses not to accept the option, it is offered to the next player on the left.

Another variation in some jurisdictions is that the Player/Dealer may be a representative of the casino for some hands and may be a player for other hands. The representative of the casino is given the same option to be Player/Dealer as the other players. For the purposes of this invention, the source of the funds for the Player/Dealer pool does not matter.

Some of the most common games played with a Player/Dealer are blackjack, Pai Gow, Pai Gow Poker, Pan 9, Easy-Poker, Caribbean Stud, and Fast 9.

There are three key features of the use of Player/Dealer wager in the current art that have a negative effect on these games: 1) A Player/Dealer wager may not be large enough to cover all wagers made by other players. 2) When another player wins or loses a wager against the Player/Dealer, only the amount won or lost is removed from action in the Player/Dealer pool. 3) When a player's wager increases during play or a bonus is earned, the Player/Dealer pool is used to fully settle the original wager before the increase or bonus is settled. There are several ways that more than one person can fund the Player/Dealer pool, but these ways do not change any of these features.

The first feature is that in most jurisdictions the casino may not require the Player/Dealer to wager enough money to cover the total amount the other players might win. In many cases, the law forbids requiring the Player/Dealer to cover all wagers. As a result, some players may not get "action" on their wagers. The wagers are settled as long as the Player/Dealer pool has funds left to cover the wagers. The remaining wagers are returned to the players.

The second feature of the current art is that settling a wager always involves removing an amount equal to the amount won or lost from the Player/Dealer pool. If a player wins, that amount is paid to the winning player from the pool. If that player loses, his wager is given to the Player/Dealer, and the same amount is removed from the Player/Dealer pool and returned to the Player/Dealer. These funds can be said to be "retired" and are no longer at risk. In the current art, if less than the original wager changes hands, such as when a blackjack player surrenders, this lesser amount is retired. If no money changes hands, no money is retired. As a result, the Player/Dealer can neither win nor lose more than his/her wager.

For example, if the Player/Dealer wagers $200, and the first player wagers $100 and wins, $100 is taken from the Player/Dealer wager and paid to the first player. Now there is $100 left in the Player/Dealer wager. If the second player has wagered $100, and loses, the $100 the player wagered is paid to the Player/Dealer and the last $100 of the Player/Dealer's wager is returned to the Player/Dealer. Any remaining players will automatically get their wagers back, since there is no more money left in the Player/Dealer pool. The players are said to "get no action" on their bets.

This is a problem because, when players get no action, it is undesirable to both the players and the casinos. Most players wager because they want the excitement of the wager and to have a chance to win. When they get no action, they get neither. Also, when a player gets no action, in many casinos the casino must refund the fee a player may have paid to play the game. This costs the casino revenue.

The third feature of the current art is that the Player/Dealer pool is used to fully settle any original wager before any bonus is paid or any additional wagers are settled. No money is held in reserve for paying bonuses or settling additional wagers.

In a blackjack game, a player with a blackjack is usually paid 3 to 2. This means that a player who wagers $100 will win $150 if he makes a blackjack. However, if there is only $100 in the Player/Dealer pool, the player will only win $100. And if the player loses, he loses $100. Normally the player risks $100 and has the chance to win $150, but with a small Player/Dealer pool, the player risks $100 and can only win $100. The result is that the Player/Dealer advantage increases significantly.

A similar problem can result when a player wants to increase his wager during the play of a hand. The most common examples are splitting pairs and doubling down in blackjack. In blackjack, a player who is dealt a pair as his first two cards can add a second wager and split the pair to form two hands. So a player who originally wagered $100 will have $100 on each of his hands. However, if the Player/Dealer pool only has $100, the second hand will receive no action, unless there is a tie on the first hand. So the player loses the chance to win $200. Again, the Player/Dealer advantage increases if the pool is small.

The situation is similar for doubling down in blackjack. A player may choose to double his wager after seeing his first two cards. The player receives exactly one more card to complete his hand. Normally this is a powerful weapon in the arsenal of the blackjack player. When the odds are in his favor, he can double his wager and frequently double his win. However, if there is not enough money in the Player/Dealer pool to cover the double wager, the player's advantage disappears. If the player wagers $100 and there is only $100 in the Player/Dealer pool, there is no reason to double down. This is another example of how the Player/Dealer advantage goes up if the pool is small.

While these examples show cases with one player against the Player/Dealer, even with many players, it is to the advantage of the Player/Dealer to wager less than the players might win. This increases the advantage for the Player/Dealer and the rate at which the other players can expect to lose.

This is bad for the players and the casino. As mentioned earlier, one result of smaller Player/Dealer pools is that players often don't get action on their wagers. This leads to unhappy players and less casino revenue. In addition, an increased advantage for the Player/Dealer hurts the players and casino as well. Players who lose quickly have less fun. They are likely to run out of money, quit sooner, and are less likely to return for more play. Since the casino typically makes money by charging a fee for each hand in a game with a Player/Dealer, all of these situations reduce casino revenue.

There are many variations of how the Player/Dealer's wager is funded, but none of them solve these problems. There are three basic variations: 1) A simple pool, 2) a shared pool, and 3) two or more distinct "sub-pools." (often called "wagering behind"). More complex variations may occur by combining these basic funding methods.

The entire amount wagered on the Player/Dealer hand will be called the "Player/Dealer pool." When this pool is made up of more than one part, and one part is settled before the others, each part will be called a "sub-pool". If there is more than one sub-pool, the sub-pools are assigned a priority, with one sub-pool being the first to be used to settle wagers and the others being used in sequence. The first sub-pool to be used will be called the "first sub-pool", the next one the "second sub-pool", etc.

With a simple pool, one person funds the entire Player/Dealer pool. Any winning wagers are paid out of this pool and losing wagers are paid to the person who funded it, as long as the pool is large enough to cover all the wagers. In essence, there is only a "first sub-pool."

With a shared pool two or more players share in funding the Player/Dealer pool. There is still only one sub-pool, but more than one player funds it. If the players share equally in funding the pool, those funding it would share equally in wins or losses. If they do not share equally in the funding, they share in the wins and losses in proportion to their shares of the pool. For example, one player might put up $100 and another player might put up $50. In this case the first player would win two-thirds of any money won by the Player/Dealer and lose two-thirds of any loss. The second player would win or lose one-third. In theory, any number of players and any ratio of bets may be combined into a single bank to fund the Player/Dealer pool.

The third variation involves two or more distinct sub-pools, where one or more of the sub-pools are said to wager "behind" the first sub-pool. For example if there are two sub-pools of $100, and three player wagers of $50, the first sub-pool might be used to settle the first two wagers, and the second sub-pool would be used to settle the third wager. However, there are many possibilities. One of the first two wagers might result in a tie or "push" where no money changes hands. In this case, the first sub-pool would cover all three wagers. Or if this were a blackjack game and the first player doubled down and doubled his wager to $100, the first sub-pool would only cover this wager, and the other sub-pool would cover the second and third wagers.

The variations of how the Player/Dealer pool is funded do not solve the problems with the current art. No matter how the Player/Dealer pool is funded, there is still a strong financial incentive to wager less than the full amount needed to cover all possible wagers.

While sub-pools provide a mechanism to increase the size of the Player/Dealer pool, the financial incentives don't support this. In most games with a Player/Dealer pool, the first sub-pool has a stronger mathematical advantage than a second or third sub-pool. Depending on the size of the pools, the second and/or third sub-pool may have a disadvantage, even if the first sub-pool has a big advantage. This is even true in a game like Pai Gow Poker, where no bonuses are paid and players cannot increase their wagers. So savvy players will usually not want to be part of a second or third pool.

Two other features of the way money is currently retired can make these problems worse. In some circumstances no money changes hands and in some circumstances less than the original bet may change hands. With the current state of the art, under those circumstances, only the amount that changes hands is retired from the Player/Dealer funds.

The most common example of no money exchanging hands is a "push", which usually happens in case of a tie. For example, in blackjack, if both players make a hand with a value of 20, it is a tie and no money changes hands. In games with a Player/Dealer, no money is retired from the Player/Dealer funds when this occurs. Due to the mathematical distribution of outcomes, in most games this results in a disadvantage for a player who funds a second or third Player/Dealer sub-pool, discouraging players from making such wagers.

The most common example of less money exchanging hands is the surrender option in blackjack. If a player doesn't like his chances in blackjack after his first two cards, in many casinos the player may choose to surrender one-half of his/her wager and get the other half back. For example, a player who has bet $100 gives up $50, but also gets $50 back. There is no further action on this player's hand and it is discarded. In games, with a Player/Dealer, typically the Player/Dealer receives the amount of the surrender and that amount is retired, not the original wager. In this example, $50 would be returned to the Player/Dealer and taken out of action.

It is a purpose of this invention to eliminate these problems from games with a Player/Dealer, by improving the ways funds are retired and changing the way funds are allocated when there are bonuses and additional wagers. It is a further purpose to provide mechanisms to simply implement the new settlement methods.

The field of this invention is any game where there is a Player/Dealer. This description calls a play of game starting with the wagers and ending with the settling of the wagers a "hand." This is the common designation of a play of games such as blackjack, Pai Gow Poker, and most other card games. However, the field of the invention covers other games that are not played with cards as well. For example, there are versions of craps, the dice game, which are played with a Player/Dealer. In this case, a complete play is called a "roll" and not a "hand". The use of the word "hand" simplifies the explanation, but does not limit the field of the invention to card games or games where a complete play is called a "hand".

SUMMARY

It is an object of this invention to provide an improved method of playing a game with a Player/Dealer by, in some circumstances, removing more money from the Player/Dealer wager funds than the amount of money that actually changes hands, and by sometimes changing the amount of money that a player can win or lose to a smaller portion of the Player/Dealer Wager. This invention also provides optional mechanisms for settling wagers and managing the Player/Dealer wager by dividing Player/Dealer pools into one or more portions called "Base Bank", used to settle original bets, and "Reserve Bank", used to settle additional bets and bonuses, before settlement of wagers begins, or by separating funds from the main pool into a "Settlement Bank" as the wagers on each hand are settled.

DETAILED DESCRIPTION

Persons of ordinary skill in the art will realize that the following disclosure is illustrative only and not in any way limiting. Other embodiments of the invention will readily suggest themselves to such skilled persons having the benefit of this disclosure.

In the following description, the amount of money wagered at the beginning of the hand, will be called the "original wager". In a blackjack game, this is the amount placed at risk before the player receives his cards and before he considers options such as splitting pairs or doubling down which can increase the amount at risk. It is also the amount at risk before exercising an option like surrender that reduces the amount the player has at risk.

In the following description, when a wager is settled, an amount of money is removed from the Player/Dealer funds. Some or all of this money may be paid to the player, if the player has won a wager. Some or all of this money may be returned to the person(s) who provided the Player/Dealer funds. All of the money removed from the Player/Dealer funds will be referred to as "retired".

Figure 1:
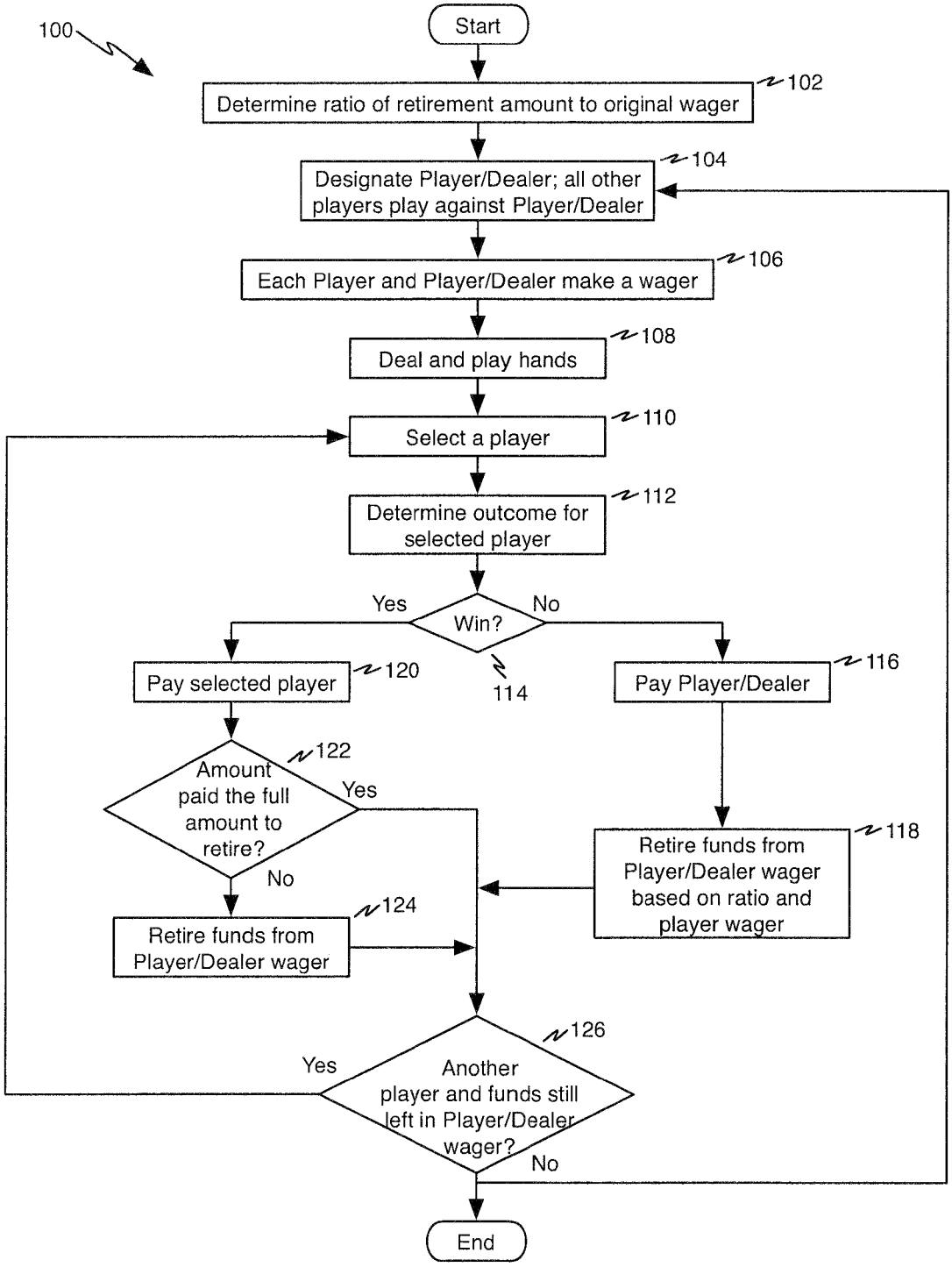
FIG. 1 is a flowchart illustrating an exemplary embodiment of the method of the present invention.

FIG. 1 illustrates an exemplary embodiment of the method of the present invention. Process 100 begins at step 102 where the ratio of the amount to be retired to the amount of the original wager is determined. At step 104, one player or a group of players is designated as the Player/Dealer. As a result, all the other players play against this Player/Dealer. At step 106, each player and the Player/Dealer then makes a wager. At step 108, hands are dealt and played. The outcomes of each hand are determined, and as a result, wagers are won and lost. At step 110, a player is selected. At step 112, the outcome for the selected player is determined.

At step 114, if the selected player has not won, any wagers lost by the selected player are paid to the Player/Dealer at step 116. At step 118, funds are retired from the Player/Dealer wager. The amount of the retired funds is based on the predetermined ratio and the player's original wager. At step 126, if there are any other remaining players whose wager needs to be settled and there is money still left in the Player/Dealer wager, a player is selected from these remaining players at step 110 and the selected player's outcome is determined as previously discussed. If there are no remaining players whose wager needs to be settled or there is no money left in the Player/Dealer wager, then the process comes to an end. Optionally, the process may repeat at step 104, where a Player/Dealer is once again designated.

At step 114, if the selected player has won, any wagers won by the player are paid to the player from the Player/Dealer's wager at step 120. At step 122, it is determined whether or not the amount paid to the player covers the full amount to be retired based on the predetermined ratio and the player's original wager. If the amount paid does cover the full amount to be retired, then it is determined whether or not there are any other remaining players whose wager needs to be settled and whether there is money still left in the Player/Dealer wager at step 126. If the amount paid does not cover the full amount to be retired, the remaining difference between the amount paid and the full amount is retired from the Player/Dealer wager at step 124. The process then continues on to step 126 where, as previously discussed, it is determined whether or not there are any other remaining players whose wager needs to be settled and whether or not there is money still left in the Player/Dealer wager.

For the description of a preferred embodiment, the game of blackjack will be used. Those of ordinary skill in the art will realize that this invention can be applied to other wagering games with a Player/Dealer.

In the preferred embodiment, as each wager is settled, an amount equal to the maximum possible win for the player is retired from the Player/Dealer funds. Those of ordinary skill in the art will realize that the amount retired could be any multiple of the original wager, a fixed amount, or another formula might be used to determine the amount retired.

For this example, a blackjack game where players may split pairs one time and may double after split will be used. In such a game, a player could end up with a total of four times his original wager. While this will not occur very often, it is the maximum the player can win or lose on any hand. This is the basis for retiring wagers and reserving funds.

In the preferred embodiment, whenever the wager for a player's hand is fully settled, an amount equal to four times the original wager is either paid to the player or retired from the Player/Dealer pool. None of these funds are used to settle any other wagers.

If there is not enough money in a Player/Dealer pool or sub-pool to cover four times the original wager, one-quarter of the pool is used to settle the original wager, and the rest is used to settle any subsequent wagers. All of this pool is then retired after the wagers on this hand are settled.

For example, if a player makes an original wager of $100 and wins $300, $300 is paid to the player and $100 more is retired from the Player/Dealer funds. The total retired equals four times the original wager. If there is only $200 in the Player/Dealer pool, $50 is used to settle the original wager and $50 is used to settle each additional $100 wager. A $100 original wager has $400 in possible action. Since the Player/Dealer pool can only cover fifty percent of the $400 possible action, it only covers fifty percent of every individual wager.

In the preferred embodiment, the ratio of the size of the base pool to the original wager determines the portion of each wager that is settled. Those of ordinary skill in the art will realize that other options are available when the Player/Dealer pool covers all the wagers by a player, even if the pool is not four-times the original wagers. For example, there might be a $100 original wager and a $300 Player/Dealer pool. If there were only a total of $200 in wagers by the player, another option would be to cover the full $200 in wagers. In this variation, only if the player's wagers exceeded the $300 Player/Dealer pool would the player receive less than 100% action on each wager.

In the preferred embodiment, if the player and Player/Dealer "push" and no money is to change hands, the full amount of four times the original wager is retired. However, those of ordinary skill in the art will realize that it is possible to have a version of the invention where no money is retired when there is a push. In fact, it is possible to have a version of this invention where money is retired only when money changes hands, a version where money is only retired when there is a push, and a version where money is retired both when money changes hands and when there is a push. All three of these versions fall within the scope of this invention.

When funds are retired after a push, it could be the amount of the original wager or a larger amount. Either amount is greater than the funds that change hands, so both of these options fall within the scope of the invention.

Figure 2:
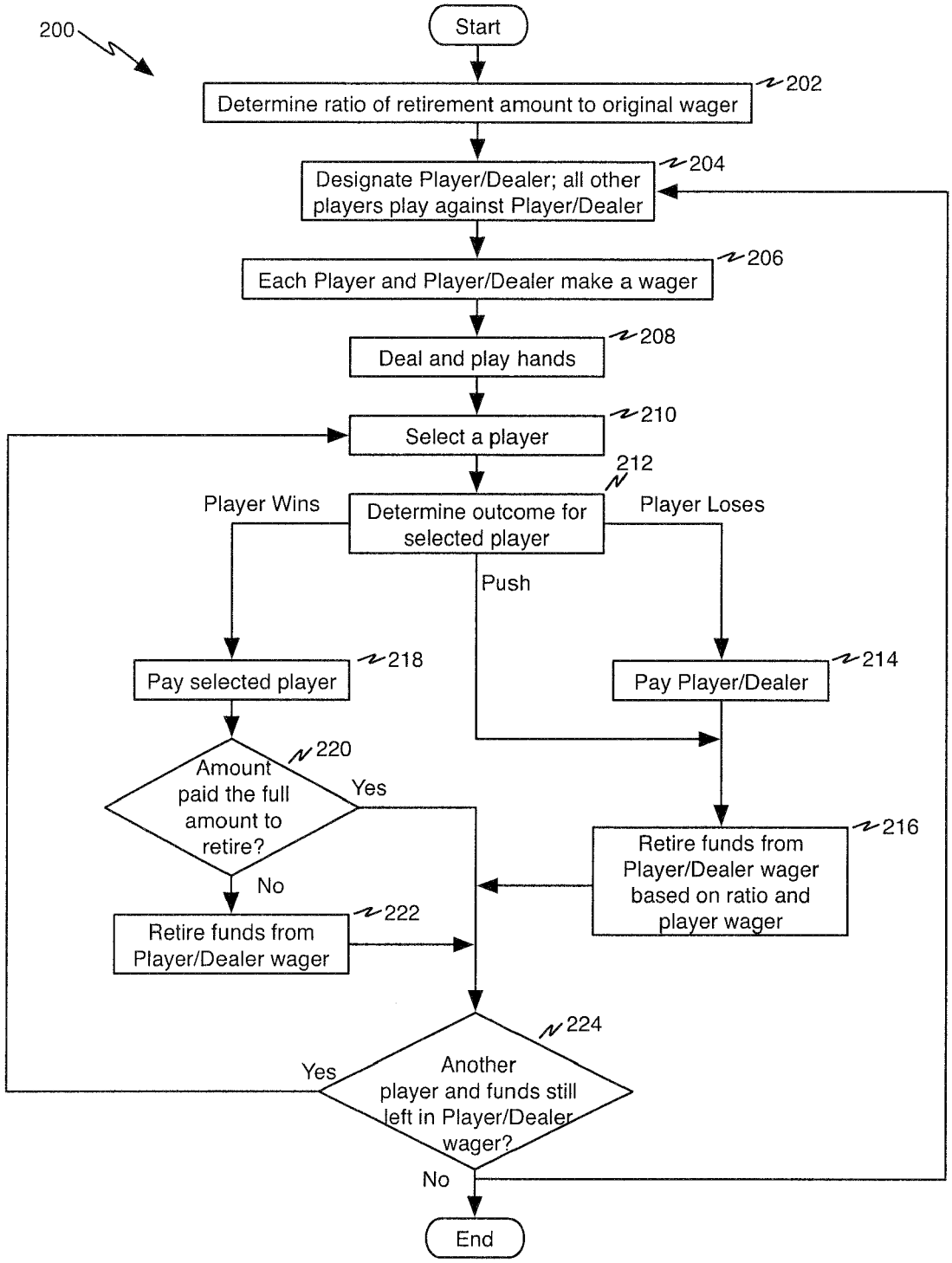
FIG. 2 is a flowchart illustrating an exemplary embodiment of a method for handling a push.

FIG. 2 illustrates an exemplary embodiment of a method of wagering settlement for casino games wherein the game being played may result in a push. Process 200 begins at step 202 where the ratio of the amount to be retired to the amount of the original wager is determined. At step 204, one player or a group of players is designated as the Player/Dealer. As a result, all the other players play against this Player/Dealer. At step 206, each player and the Player/Dealer then makes a wager. At step 208, hands are dealt and played. The outcomes of each hand are determined, and as a result, wagers are won and lost. At step 210, a player is selected. At step 212, the outcome for the selected player is determined.

If the selected player loses, any wagers lost by the selected player are paid to the Player/Dealer at step 214. At step 216, funds are retired from the Player/Dealer wager. The amount of the retired funds is based on the predetermined ratio and the player's original wager. At step 224, if there are any other remaining players whose wager needs to be settled and there is money still left in the Player/Dealer wager, a player is selected from these remaining players at step 210 and the selected player's outcome is determined as previously discussed. If there are no remaining players whose wager needs to be settled or there is no money left in the Player/Dealer wager, then the process comes to an end. Optionally, the process may repeat at step 204, where a Player/Dealer is once again designated.

At step 212, if there is a push, the process proceeds to step 216 where funds are retired from the Player/Dealer wager as previously discussed.

At step 212, if the selected player has won, any wagers won by the player are paid to the player from the Player/Dealer's wager at step 218. At step 220, it is determined whether or not the amount paid to the player covers the full amount to be retired based on the predetermined ratio and the player's original wager. If the amount paid does cover the full amount to be retired, then it is determined whether or not there are any other remaining players whose wager needs to be settled and whether there is money still left in the Player/Dealer wager at step 224. If the amount paid does not cover the full amount to be retired, the remaining difference between the amount paid and the full amount is retired from the Player/Dealer wager at step 222. The process then continues on to step 224 where, as previously discussed, it is determined whether or not there are any other remaining players whose wager needs to be settled and whether or not there is money still left in the Player/Dealer wager.

Although in the preferred embodiment, funds are always retired when there is a push, those of ordinary skill in the art will realize that the rules could specify that these funds only be retired if there is another sub-pool that would settle wagers after the funds in this pool are used up. The primary reason to retire funds on a push is that the alternative, not retiring the funds, hurts any sub-pools that settle after this one. If the funds in this pool were not retired on a push, these funds might be used to settle other wagers, thereby cutting into the action of these other sub-pools. As a result, the action on these additional sub-pools would be reduced and possibly even eliminated. However, if there are no additional sub-pools, then there is no one to hurt. Also, when there is no additional sub-pool, the casino would want to give as many players as much action on their bets as possible.

Those of ordinary skill in the art will also realize that there is another possible rule variation. If the Player/Dealer pool is large enough to cover all wagers on the table, even if money were normally retired on pushes, in this situation no money would be retired on pushes. Only if there is a chance that the Player/Dealer fund would not cover all wagers, would funds be retired after pushes. This would speed up the game when retiring the funds doesn't affect anything.

In the preferred embodiment, if a player surrenders, the full amount of four times the original wager is retired. However, those of ordinary skill in the art will realize that other options might be used for surrender. Only the original wager might be retired or only the amount surrendered might be retired.

In the preferred embodiment, an amount equal to the maximum a player could win is retired. Those of ordinary skill in the art will realize that many other formulas may be used. The amount retired could be based on the amount of the original wager, the amount of money that changes hands, the casino's limit on maximum bet allowed, or a formula that combines these factors. For example, a casino might determine that for 99% of the hands played, no more than three times the original bet exchanges hands, and the casino could decide to retire three times the original bet, even if occasionally a player may win or lose up to four times the original wager. As long as an amount greater than the amount that changes hands is retired on some occasions, that falls within the scope of this invention.

In blackjack, there are other options available, which might be classified as optional bets. The most common is called "Insurance". When the dealer's face-up card is an ace, the players have an option to bet on whether the dealer has a "blackjack" which would occur if the dealer's facedown card is a ten, jack, queen, or king. Typically the insurance bet pays 2-1, which means that a $100 insurance bet can win $200. This is completely separate from any wager on a hand, although typically an insurance bet cannot exceed one-half the original bet on a hand.

Other optional bets may pay even larger amounts. For example, some casinos allow an optional bet that pays 25-1 if the player is dealt a king and queen of the same suit. These optional bets might increase the amount of money a player can win in relation to the original wager and might lead a casino to increase the amount that is retired and reserved when wagers are settled.

This invention may also cover games where the players do not increase the size of their wagers. There are games where the players may decrease the amount of money they have at risk. For example, there is a game called "Let It Ride" where a player makes three wagers and may take back one or more of these wagers as the game proceeds. When games like this are played with a Player/Dealer and more money is retired from the Player/Dealer funds than changes hands, it falls within the scope of this invention.

There are also games where the amount wagered remains constant. In games like Pai Gow, Pai Gow Poker, baccarat, and many others, the player may win or lose no more than the original wager. However, when played with a Player/Dealer and when there is a push, in the current state of the art, no money is retired. Under this invention, money could be retired in these games in case of a push. If money is retired when no money changes hands, that would fall within the scope of this invention.

After all the wagers made by all the players are settled, all the remaining Player/Dealer funds are returned to the player(s) who wagered these funds. This does not fall into the scope of "retiring" funds as described here. If more funds than the amount of the wager are only returned after all the wagers are settled, this does not fall within the scope of this invention. This invention covers games where more than the amount that changes hands may be retired when there are still wagers to be settled.

The preferred embodiment uses a mechanism called "Base and Reserve Banks" to facilitate this method of retiring and reserving funds. Under this mechanism, every Player/Dealer pool or sub-pool is divided into a Base Bank and a Reserve Bank before any wagers are settled. If one-quarter of the funds are used to settle original wagers, then the Base Bank will consist of one-quarter of the Player/Dealer pool or sub-pool and the remaining funds are "reserved" to cover bonuses and additional wagers. The remaining three-quarters is the Reserve Bank. As the wagers are settled, each original wager is settled from the Base Bank. Any bonuses are paid and any additional wagers (such as splits or double downs) are settled from the Reserve Bank. When all this is finished, enough money is returned to the Player/Dealer(s) who funded this pool to retire three times the original wager from the Reserve Bank for this pool.

Figure 3:
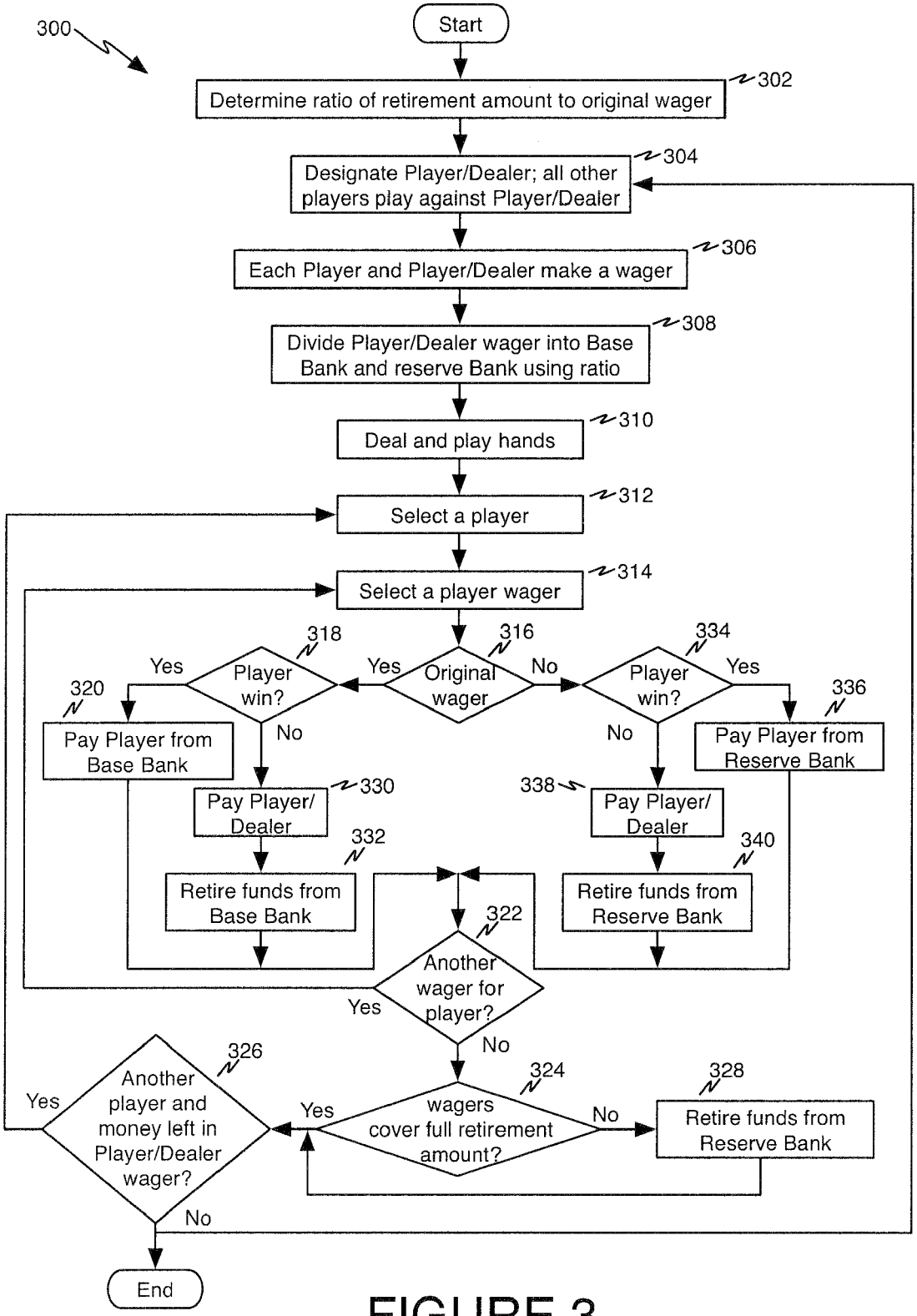
FIG. 3 is a flowchart illustrating an exemplary embodiment of the Base and Reserve Bank mechanism of the present invention.

FIG. 3 illustrates an exemplary embodiment of the Base and Reserve Bank mechanism of the present invention. Process 300 begins at step 302 where the ratio of the amount to be retired to the amount of the original wager is determined. At step 304, one player or a group of players is designated as the Player/Dealer. As a result, all the other players play against this Player/Dealer. At step 306, each player and the Player/Dealer then makes a wager.

At step 308, each Player/Dealer wager is divided into a Base Bank and a Reserve Bank. As discussed above, the Base Bank is a predetermined portion of the Player/Dealer's pool that is only used to settle the amount that the selected player wagered at the start of play. The Reserve Bank is another predetermined portion of the Player/Dealer's pool that is only used to settle any additional wagers or pay any bonuses. These predetermined portions are preferably determined by the ratio discussed above. The Base Bank and the Reserve bank may each comprise more than one bank. For example, the Reserve Bank may be divided into two banks, one bank to only be used for paying bonuses and a second bank to only be used for settling additional wagers. While this FIG. 3 shows this Base and Reserve Bank division occurring in between particular steps, it is contemplated that this division may take place at any time prior to the settling of wagers.

At step 310, hands are dealt and played. The outcomes of each hand are determined, and as a result, wagers are won and lost. At step 312, a player is selected. At step 314, one of the selected player's wagers is selected for settlement. At step 316, it is determined whether or not the selected player wager is the original wager.

If the selected player wager is the original wager, it is then determined at step 318 whether or not the selected player won. If the player won, the original wager is paid to the player from the Base Bank at step 320. It is then determined at step 322 whether or not the selected player has any other wagers to be settled. If there are still wagers to be settled, a wager is selected once again at step 314. If there is not another wager to be settled for the selected player, it is determined at step 324 whether or not the total amount of the selected player's wagers covers the full amount to be retired. If the additional wager does cover the full amount to be retired, the process then continues on to step 326 where it is determined whether or not there are any other remaining players whose wager needs to be settled and if there is money still left in the Player/Dealer wager. If there is another player whose wager needs to be settled and there is still money left in the Player/Dealer wager, a player is selected from these remaining players at step 312 and the selected player's outcome is determined as previously discussed. If there are no remaining players whose wager needs to be settled or there is no money left in the Player/Dealer wager, then the process comes to an end. Optionally, the process may repeat at step 304, where a Player/Dealer is once again designated. At step 324, if the total amount of the selected player's wagers does not cover this full retirement amount, then funds are retired from the Reserve Bank at step 328. It is then determined at step 326 whether or not there are any other remaining players whose wager needs to be settled and if there is money still left in the Player/Dealer wager, as previously discussed.

At step 318, if the selected player has not won, any wagers lost by the selected player are paid to the Player/Dealer at step 330. At step 332, funds are retired from the Base Bank. It is then determined at step 322 whether or not the selected player has any other wagers to be settled, as previously discussed.

If at step 316 it is determined that the selected player wager is not the original wager, but rather an additional wager, it is then determined at step 334 whether or not the selected player won. If the player won, this additional wager is paid to the player from the Reserve Bank at step 336. At step 322, it is determined whether or not the selected player has any other wagers to settle, as previously discussed.

At step 334, if the selected player has not won, any wagers lost by the selected player are paid to the Player/Dealer at step 338. At step 340, funds are retired from the Reserve Bank. It is then determined at step 322 whether or not the selected player has any other wagers to be settled, as previously discussed.

While the preferred embodiment reveals a mechanism with two banks, those of ordinary skill in the art will realize that the Player/Dealer pool could be divided into more than two banks. For example, one bank might only be used to settle the original wagers, a second might be used to pay bonuses on blackjacks, and yet another pool might be used to settle additional wagers. Or if there are other bonuses, a third bank might be uses to settle those. Many other variations are possible.

Those of ordinary skill in the art will realize that there are other mechanisms that could be used to implement the invention. For example, one method is to simply settle the wagers and retire the funds from the Player/Dealer pool or sub-pool. For example, a player might make a $100 bet in blackjack and due to split pairs the player might win $200 on two hands and lose $100 on a third. If the amount to retire were four times the original wager, the player would be paid $200 from the pool, $100 would be removed when the losing bet is collected and an additional $100 would be removed from the pool and given back to the Player/Dealer. If there were less than $400 in the pool or sub-pool, the wagers would be settled according to the proportion available and money would be reserved to settle bonuses and additional bets.

Another possible method is to separate out the funds at the time of settlement. If a total of $400 is to be either paid to the player or retired, that $400 is separated from the main Player/Dealer pool into a "Settlement Pool". All the wagers for that original wager are settled from that Settlement Pool. In the example above, $200 is paid to the player, and the $100 losing bet is given to the Player/Dealer. The rest is returned to the Player/Dealer and retired from action. If the Settlement Pool were less than the full $400, the wagers would be settled accordingly. The Settlement Pool could also be divided into a Base Bank and Reserve Bank, where these banks are only used to settle wagers on one hand. The use of the Settlement Pool is an innovation and is covered by this invention.

The preferred embodiment involves the use of "Base Bank" and "Reserve Bank". These banks are formed by dividing each sub-pool of the Player/Dealer pool into two or more portions. The use of the word "bank" here does not mean that the funds come from that casino or that this is a "banking game". It is used to describe a division of pools of money.

These methods of retiring and reserving funds are a significant improvement over the current state of the art. The reserve feature insures that the amount a player can win, compared to the amount he can lose, does not go down because the Player/Dealer wager is small. As a result the game is fairer to the players. The retirement features insure that Player/Dealer wagers after the first sub-pool are not at a disadvantage. The result of these features is that the players are more likely to get full action on their wagers, improving the game for all parties and increasing casino revenues.

Although the invention has been illustrated and described in detail herein, it is to be understood that various changes and modifications may be made therein without departing from the spirit and scope of the invention as defined in the appended claims.

While the invention has been described with reference to an exemplary embodiment, it will be understood by those skilled in the art that various changes and modifications may be made and equivalents may be substituted for elements thereof without departing from the spirit and scope of the invention as defined in the appended claims. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A method of playing a game between players comprising:

designating one player or group of players as the Player/Dealer, wherein all other players are playing against this Player/Dealer;

each player and the Player/Dealer makes a wager;

each player and the Player/Dealer plays a hand, wherein the outcome of each hand determines whether wagers are won or lost;

settling the wagers, wherein wagers won by the other players are paid from the Player/Dealer wager and wagers lost by the other players are paid to the Player/Dealer;

wherein after a wager is settled, some or all of the Player/Dealer wager is returned to the player or group of players who funded the Player/Dealer wager; and wherein the amount returned to the player or group of players who made the Player/Dealer wager may exceed the amount won or lost on the wager, even if there are more wagers to be settled.

2. The method of claim 1:

wherein the amount a player may win may exceed his wager at the start of play;

wherein a pre-determined portion of the Player/Dealer's wager is only used to settle the amount the player wagered at the start of play; and wherein another pre-determined portion of the Player/Dealer's wager is used to settle any additional wagers or pay any bonuses.

3. The method of claim 2 wherein the sum of the amount won and lost by a player plus the amount returned to the player or group of players who made the Player/Dealer wager equals the maximum that player could have won or lost based on the wager that player made at the start of the hand.

4. The method of claim 3 wherein the sum of the amount won and lost by a player plus the amount returned to the player or group of players who made the Player/Dealer wager equals the sum of the portion used to settle the amount the player wagered at the start of play and the amount allocated to settle any additional wagers or pay any bonuses.

5. The method of claim 2 wherein the sum of the amount won and lost by a player plus the amount returned to the player or group of players who made the Player/Dealer wager equals a fixed multiple of the amount the player wagered at the start of play.

6. The method of claim 5 wherein the sum of the amount won and lost by a player plus the amount returned to the player or group of players who made the Player/Dealer wager equals the maximum that player could have won or lost based on the wager that player made at the start of the hand.

7. The method of claim 2 wherein a fixed portion of the Player/Dealer wager is separated from the other funds before any wagers are settled, the fixed portion is used to settle wagers placed at the beginning of the hand and the remainder of the Player/Dealer wager is held in reserve to pay bonuses and settle additional wagers.

8. The method of claim 2 wherein a fixed portion of the Player/Dealer wager is separated from the other funds before the wagers on a particular hand are settled, the fixed portion is used to settle wagers placed on this hand.

9. The method of claim 8 wherein the specified fixed portion of the Player/Dealer wager is divided again into two portions according to pre-determined rules where one portion is used to settle wagers placed at the beginning of the hand and remainder of the Player/Dealer wager is held in reserve to pay bonuses and settle additional wagers.

10. The method of claim 1 wherein a fixed portion of the Player/Dealer wager is separated from the other funds before the wagers on a particular hand are settled, the fixed portion is used to settle wagers placed on this hand.

11. The method of claim 10 wherein the specified fixed portion of the Player/Dealer wager is divided again into two portions according to pre-determined rules where one portion is used to settle wagers placed at the beginning of the hand and the remainder of the Player/Dealer wager is held in reserve to pay bonuses and settle additional wagers.

12. A method of playing a game between players comprising:

designating one player or group of players as the Player/Dealer, wherein all other players are playing against this Player/Dealer;

each player and the Player/Dealer makes a wager;

each player and the Player/Dealer plays a hand, wherein the outcome of each hand determines whether wagers are won or lost;

settling the wagers, wherein wagers won by the other players are paid from the Player/Dealer wager and wagers lost by the other players are paid to the Player/Dealer;

wherein the amount a player may win may exceed his wager at the start of play;

wherein a pre-determined portion of the Player/Dealer's wager is only used to settle the amount the player wagered at the start of play; and wherein another pre-determined portion of the Player/Dealer's wager is only used to settle additional wagers or pay bonuses.

13. A method of playing a game between players comprising:

designating one player or group of players as the Player/Dealer, wherein all other players are playing against this Player/Dealer;

each player and the Player/Dealer makes a wager;

each player and the Player/Dealer plays a hand, wherein the outcome of each hand determines whether wagers are won or lost or whether there is a push;

settling the wagers, wherein wagers won by the other players are paid from the Player/Dealer wager and wagers lost by the other players are paid to the Player/Dealer;

wherein if the outcome of a hand results in a push, the amount of the Player/Dealer wager is returned to the player or group of players, who made the Player/Dealer wager.

14. The method of claim 13 wherein if the outcome of a hand results in a push, funds are only returned to the player or group of players who made the Player/Dealer wager associated with said hand resulting in a push if there is another Player/Dealer wager available to settle the other wagers.

* * * * *